United States Patent [19]

Kirchner

[11] 3,942,486

[45] Mar. 9, 1976

[54] HYDRAULIC FAN DRIVE SYSTEM SPEED CONTROL

[75] Inventor: Harold G. Kirchner, Issaquah, Wash.

[73] Assignee: The United States of America as represented by the Secretary of the Army, Washington, D.C.

[22] Filed: Aug. 21, 1974

[21] Appl. No.: 499,240

[52] U.S. Cl. ..... 123/41.12; 123/41.02; 236/100; 417/222

[51] Int. Cl.[2] ..... F01P 7/02

[58] Field of Search ..... 123/41.11, 41.12, 41.02; 165/51; 417/212, 222; 60/492; 236/100

[56] References Cited

UNITED STATES PATENTS

| | | | |
|---|---|---|---|
| 1,256,709 | 2/1918 | Ludeman | 123/41.12 |
| 2,594,460 | 4/1952 | Lauck | 123/41.12 |
| 3,131,269 | 4/1964 | Asakawa | 236/100 |
| 3,204,411 | 9/1965 | Stockton | 60/492 |
| 3,234,793 | 2/1966 | Vernet | 236/100 |
| 3,354,978 | 11/1967 | Budzich | 417/222 |
| 3,386,065 | 5/1968 | Algino | 236/100 |
| 3,394,682 | 7/1968 | Bensinger | 123/41.12 |
| 3,563,093 | 2/1971 | Scherer | 236/100 |
| 3,710,765 | 1/1973 | Dorsch | 123/41.12 |

*Primary Examiner*—Charles J. Myhre
*Assistant Examiner*—Daniel J. O'Connor
*Attorney, Agent, or Firm*—Nathan Edelberg; Robert P. Gibson; John E. McRae

[57] ABSTRACT

Conventional engine cooling systems include fans driven at speeds proportional to engine speed, thereby producing excessive cooling at higher engine speeds. It is proposed herein to limit or control the fan speed by utilizing a drive mechanism that is controlled by a thermal power element responsive to coolant temperature. The control element is arranged to vary the displacement of a variable displacement pump that is driven from the engine. The pump output is delivered to a hydraulic motor that drives the fan. Variations in pump displacement produce varying hydraulic motor speeds, hence varying fan speeds. This is particularly applicable to powertrains using hydrokinetic or hydromechanical transmissions which require high cooling capacity at low engine speeds.

1 Claim, 2 Drawing Figures

Fig-1
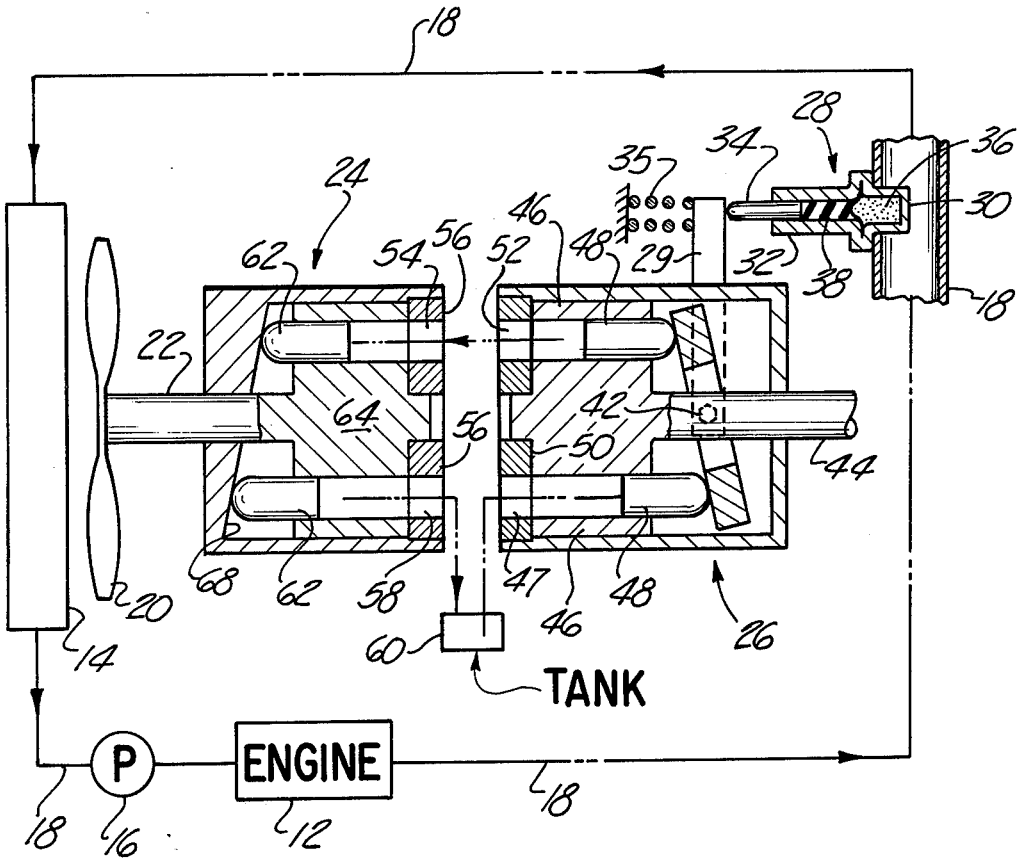
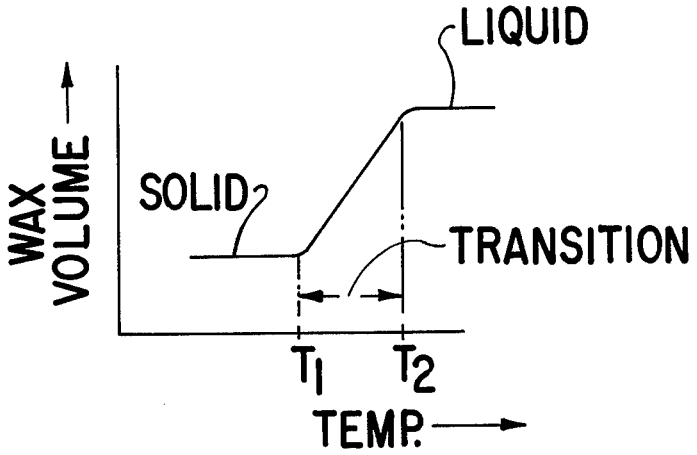
Fig-2

HYDRAULIC FAN DRIVE SYSTEM SPEED CONTROL

BACKGROUND OF THE INVENTION

Various thermally responsive drive mechanisms have heretofore been proposed for use with engine coolant fans. The present invention provides a drive mechanism that uses proven conventional pumps, motors, and control devices, as distinguished from special single purpose components that require extensive design and testing effort. The conventional pumps and motors are readily procurable as shelf items in a range of sizes, thereby permitting drive mechanisms to be fabricated for different engines and different cooling requirements with minimum development effort.

THE DRAWINGS

FIG. 1 is a schematic representation of a fan drive mechanism embodying the invention.

FIG. 2 is a graphical representation of the operation of a thermal power element used in the FIG. 1 mechanism.

THE DRAWINGS IN GREATER DETAIL

FIG. 1 shows a conventional liquid cooling system (water and anti-freeze) for an internal combustion engine 12 used to power a truck or similar vehicle (not shown). The cooling system includes a radiator 14 and water pump 16 interconnected with each other and with the engine by means of a liquid line 18.

The radiator is cooled by a fan 20 connected to a drive shaft 22 extending from a conventional fixed displacement hydraulic motor 24. Hydraulic pressure fluid is supplied to motor 24 from a conventional variable displacement pump 26. Pump displacement is controlled and varied by means of a conventional thermostatic power element 28 of the type commonly used in liquid line thermostats and radiator shutter controls.

As shown in FIG. 1, power element 28 comprises a cup-like metallic container 30 connected to a tubular guide member 32 for a slidable piston 34. Wax or similar solid expansion material 36 is precharged into container 30. A plug of rubber sealing material 38 is interposed between expansion material 36 and piston 34 to prevent escape of the expansion material when it is heated to undergo its transition from the solid to the liquid state.

The power element is preferably located with its wax container 30 extending against or within liquid line 18 such that the wax is heated and/or cooled by the coolant flowing through the line. The power element is preferably located at a point in line 18 upstream from radiator 14 and downstream from engine 18. (This is to make the fan react as soon as possible to change in engine coolant temperature.) The power element is mounted on pump 26 such that its piston 34 controls the position of an annular swash plate 40. For visualization purposes the piston is shown operatively engaged with a swash plate control arm 29 carried by a stub shaft 42 extending from plate 40. The swash plate is mounted for rotational adjustment around a transverse axis defined by stub shafts 42 that extend from the swash plate through bearings in housing 27. The above mentioned control arm 29 could be connected to one of the stub shafts in the fashion of the swash plate control arm 70 shown in U.S. Pat. No. 3,204,411 issued to T. R. Stockton on Sept. 7, 1965. In some engine installations pump 26 might be of such size that power element 28 would have insufficient stroke or total force to directly control the pump displacement (e.g. swash plate position). In such case the power element could be arranged to operate a hydraulic servo unit having a suitable source of power, e.g. the pump itself. The servo unit would be connected to the pump displacement control arm or pressure compensator device.

The illustrated swash plate 40 is moved from an upright "minimum pump displacement" position to its FIG. 1 "maximum pump displacement" position by expansive action of wax material 36 on piston 34; an opposing return force is provided by return spring 35. FIG. 2 illustrates the volume changes experienced by the wax pellet 36 as it is heated through its transition temperature range. As the wax temperature is raised from value $T_1$ toward value $T_2$ the wax undergoes fusion and expansion, thereby moving the piston 34 leftwardly to the position shown in FIG. 1. At temperatures between $T_2$ and $T_1$ the wax assumes a partially expanded condition enabling spring 35 to bias plate 40 clockwise from its illustrated position. At temperatures below $T_1$ the wax is sufficiently contracted to permit spring 35 to move plate 40 into an upright minimum pump displacement position at right angles to power input shaft 44. Power elements having desired actuation temperature ranges are available from various manufacturers, e.g. Dole Valve Co. or Scovill Manufacturing Co.; in this case a power element is selected that will provide solid-liquid transition in the temperature range at which it is desired to vary the displacement of pump 26.

Pump 26 conventionally includes a rotary barrel 46 connected to the power input shat 44 that is driven from the engine. A number of pistons 48 are slidably positioned within bores in barrel 46, whereby rotary motion of the barrel produces reciprocating motion of the pistons in accordance with the angulation of plate 40. The action is conventional, as for example described in U.S. Pat. No. 3,354,978 issued to T. Budzich on Nov. 28, 1967.

Low pressure hydraulic fluid is admitted to pump 26 through a semi-circular slot 47 located in a stationary valve plate 50. High pressure fluid is discharged from the pump through a semi-circular slot 52 in plate 50. The high pressure fluid is fed to hydraulic motor 24 through a semi-circular slot 54 in stationary valve plate 56. Spent fluid is directed through a semi-circular slot 58 back to tank 60 for later readmission to pump 26. Instead of the illustrated pump a variable displacement vane pump could be used. The thermostatic power element would then be connected to the conventional plunger used to vary the pump's pressure chamber ring.

The illustrated hydraulic motor 24 includes pistons 62 mounted for reciprocatory movements within bores in rotary barrel 64 that connects with fan shaft 22. High pressure fluid admitted through slot 54 exerts pressure on pistons 62; the motor housing reaction surface 68 translates such pressure into rotation of barrel 64 and the connected fan shaft 22. Motor 24 is a conventional item of hardware. In lieu of the illustrated motor a gear or vane motor can be used.

The invention relates generally to the functional interrelation of three conventional structures, namely thermostatic power element 28, variable displacement pump 26, and hydraulic motor 24. Element 28 is arranged to adjust pump 26 to its maximum displacement position when the coolant in line 18 tends to go above transition temperature $T_2$; under such conditions motor 24 operates at its maximum rotational speed for achievement of maximum fan cooling of radiator 14 and the flowing coolant. As the fan action causes the coolant temperature to drop into the transitional temperature range (between $T_2$ and $T_1$) the wax pellet contracts to permit spring 35 to force swash plate 40 in a clockwise direction, thereby reducing the pump 26 displacement.

Such reduced displacement provides lessened hydraulic pressures on pistons 62 and lessened rotational speeds of barrel 64 and the associated fan 20. At coolant temperatures below $T_1$ the swash plate 40 may assume a "zero pump displacement" position, in which event the fan may assume a substantially motionless condition.

In general, power element 28 has the effect of controlling the fan speed in accordance with the coolant load provided by radiator 14. At high radiator coolant loads the fan speed is high; at low radiator coolant load the fan speed is low. The invention achieves a saving in the power needed to operate the fan and a general reduction in fan noise. The speed control action can be made to occur over a range of temperatures ($T_2$–$T_1$), so that the fan speed changes are relatively gradual; the gradualness may be an advantage in reducing stress on the mechanism and in minimizing coolant temperature fluctuations. The invention is believed usable with relatively large engines which might not be the case with other "clutch" type speed changers.

I wish it to be understood that I do not desire to be limited to the exact details of construction shown and described, for obvious modifications will occur to a person skilled in the art.

It is claimed:

1. In an engine cooling system comprising a radiator, conduit means 18 connecting the radiator with the engine in the closed loop circuit, and a fan 20 for moving air through the radiator: the improvement comprising means for driving the fan at varying speeds related to variations in radiator heat load; said driving means including a variable displacement hydraulic pump 26 having pistons 48 and a swash plate movable about adjustment axis 42 for changing the pumping strokes of the pistons and hence the pump delivery, a fixed displacement hydraulic motor 24 receiving the output of the pump, a drive connection 22 from the motor to the fan, power means for moving the swash plate around adjustment axis 42; said power means comprising a thermostatic power element 28 that includes a contained mass of fusible material 36 transformable over a temperature range between a low volume solid state and a high volume liquid state, and a piston 34 movable in response to volume change in the fusible material, said thermostatic power element having its fusible material in thermal engagement with liquid coolant flowing from the engine to the radiator; and control means 29 connected with the power element piston for directionally moving the swash plate to decrease the pump displacement as the fusible material is transformed from the high volume liquid state to the low volume solid state.

* * * * *